US005170682A

United States Patent [19]

Sorensen et al.

[11] Patent Number: 5,170,682

[45] Date of Patent: * Dec. 15, 1992

[54] QUICK ACTION BAR CLAMP

[75] Inventors: Joseph A. Sorensen; Dwight L. Gatzemeyer, both of Lincoln, Nebr.

[73] Assignee: Petersen Manufacturing Co., Inc., DeWitt, Nebr.

[ * ] Notice: The portion of the term of this patent subsequent to May 22, 2007 has been disclaimed.

[21] Appl. No.: 646,397

[22] Filed: Jan. 31, 1991

Related U.S. Application Data

[63] Continuation-in-part of Ser. No. 480,283, Feb. 15, 1990, Pat. No. 5,009,134, which is a continuation-in-part of Ser. No. 234,173, Aug. 19, 1988, Pat. No. 4,926,722.

[51] Int. Cl.[5] ..... B25B 5/02

[52] U.S. Cl. ..... 81/487; 81/152; 269/170; 269/88; 269/4

[58] Field of Search ..... 81/487, 126, 152; 269/166, 167, 170, 169, 165, 6, 203, 204, 88, 4, 81, 91, 95; 29/239

[56] References Cited

U.S. PATENT DOCUMENTS

| | | | |
|---|---|---|---|
| 1,878,624 | 9/1932 | Estes | 29/239 |
| 3,096,975 | 7/1963 | Irwin | 269/169 |
| 3,933,346 | 1/1976 | Carver | 269/4 |
| 4,042,264 | 8/1977 | Shumer | 269/203 |
| 4,220,322 | 9/1980 | Hobday . | |
| 4,306,710 | 12/1981 | Vosper | 269/204 |
| 4,339,113 | 7/1982 | Vosper | 269/204 |
| 4,926,722 | 5/1990 | Sorensen et al. | 81/487 |
| 5,005,449 | 4/1991 | Sorensen et al. | 81/152 |
| 5,009,134 | 4/1991 | Sorensen et al. | 81/487 |

*Primary Examiner*—Roscoe V. Parker

*Attorney, Agent, or Firm*—Lackenbach Siegel Marzullo & Aronson

[57] ABSTRACT

A bar clamp having a fixed jaw and a movable jaw which is radially movable over both short and long distances to clamp against a workpiece and is operable using one hand with complete control by the operator at all times. The jaws may either face one another while being mounted on the same side of a handle/grip assembly or face in opposite directions while being mounted on opposite sides of the handle/grip assembly whereby they may be incrementally advanced by the trigger handle/driving lever. The movable jaw may also be a clamp jaw affixed to a handle assembly which moves toward a substrate.

17 Claims, 13 Drawing Sheets

FIG. 5
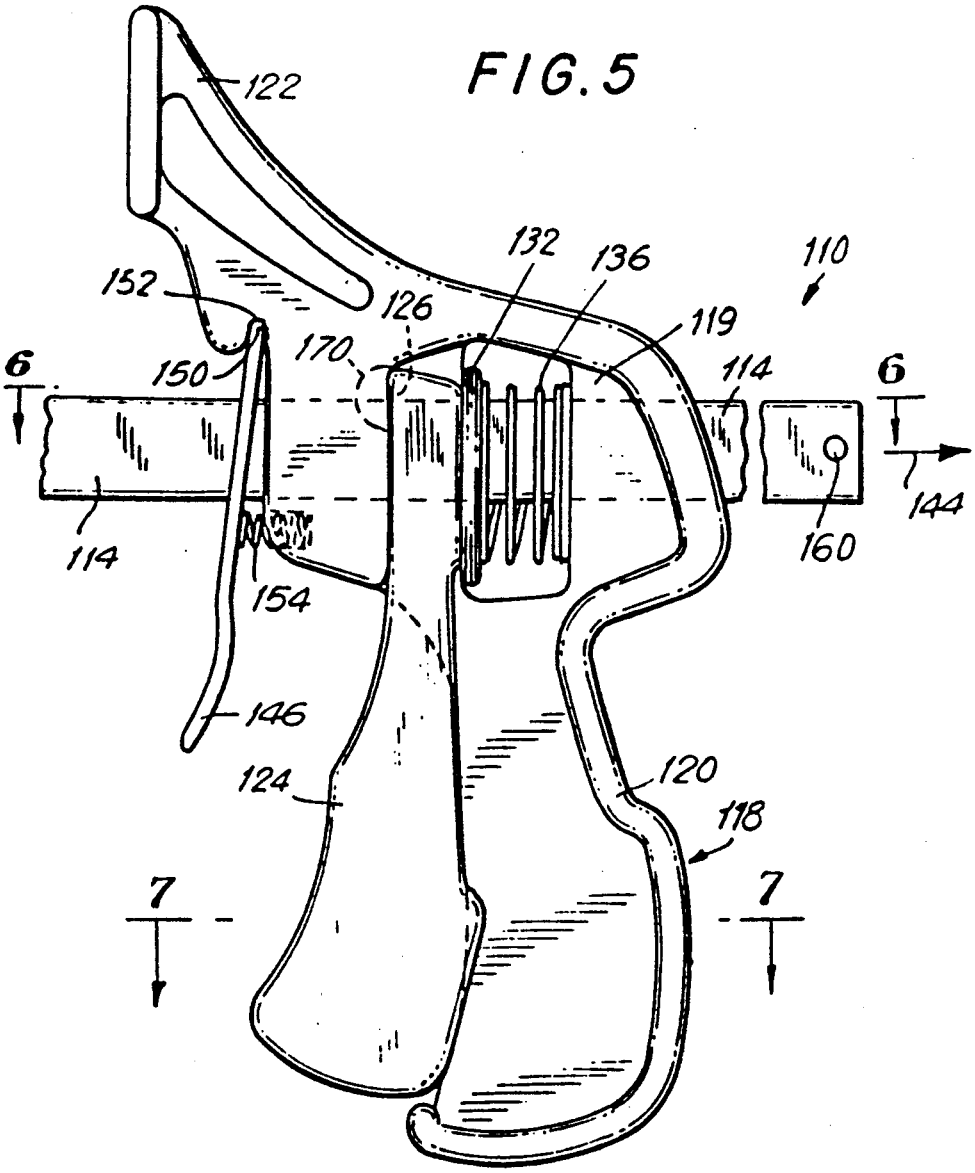
FIG. 6
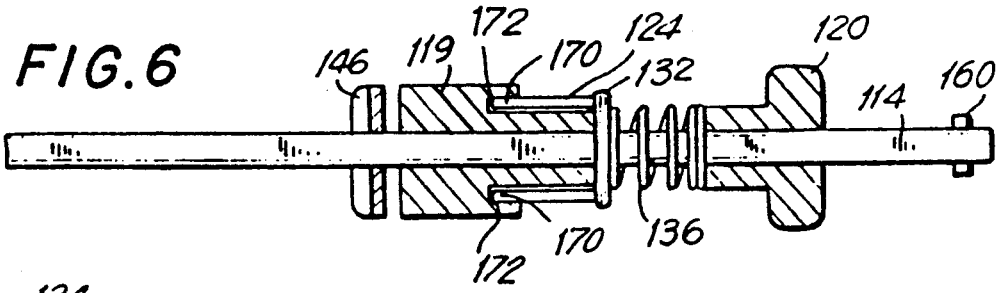
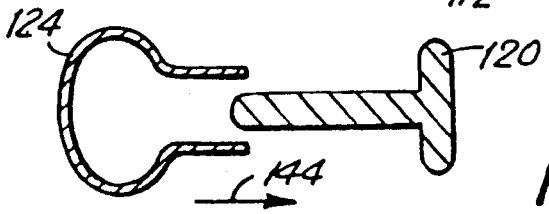
FIG. 7

QUICK ACTION BAR CLAMP

This application is a continuation-in-part application of Ser. No. 480,283 filed Feb. 15, 1990 now U.S. Pat. No. 5,009,134, which is a continuation-in-part application Ser. No. 234,173, filed Aug. 19, 1988, now U.S. Pat. No. 4,926,722.

BACKGROUND OF THE INVENTION

This invention relates generally to a bar clamp of the type used to temporarily clamp together two articles, for example, for gluing, or to hold a workpiece for welding, and more particularly to a quick-action bar clamp wherein the moving jaw can be rapidly advanced or advances in small increments of selectable length. The concept of a bar clamp is old and well-known. In recent years, over-center toggle action handgrips have been incorporated for use in final tightening against the workpiece, for example, in U.S. Pat. No. 4,088,313 by Pearson and U.S. Pat. No. 4,563,921 by Wallace. A disadvantage in the prior art lies in the fact that adjustment in the moving jaw over a substantial distance is cumbersome and imprecise. Frequently, the moving jaw is entirely disengaged and free to move until the final tightening of an object between the movable and fixed jaws is accomplished. A third hand would be helpful.

What is needed is a bar clamp having a moving jaw which is rapidly movable over both short and long distances to clamp against a workpiece and is operable using one hand with complete control by the operator at all times.

SUMMARY OF THE INVENTION

Generally speaking, in accordance with the invention, a bar clamp especially suitable for rapid and precise closure against a workpiece is provided. The clamp includes a fixed jaw and a movable jaw opposing the fixed jaw. The movable jaw connects at one end to a slide bar which is movable to bring the movable jaw toward and away from the fixed jaw. One-way drive means, by operation of a trigger handle grip, releasably engages the slide bar and advances the movable-jaw toward the fixed jaw. The one-way drive means is incapable of moving the slide bar and movable jaw away from the fixed jaw. Return motion of the movable jaw is accomplished manually when the one-way drive means is disengaged. A first braking lever which is biased to bind against the slide bar prevents reverse motion of the movable jaw away from the fixed jaw, except when the first lever is disengaged from the slide bar. Thus, for return motion of the jaw, it is necessary that both the one-way drive means and the first braking lever be disengaged. The trigger handle advances the slide bar by driving a second lever which binds against a surface of the slide bar and moves the rod as the second lever moves toward the fixed jaw. The second lever is returned by spring force to its original position after each stroke of the trigger handle, the second lever sliding over the bar surface during its return motion.

Accordingly, it is an object of this invention to provide an improved quick-action bar clamp wherein the moving jaw may be moved over short and long distances rapidly.

Another object of this invention is to provide an improved quick-action bar clamp, wherein the moving jaw may be incrementally and precisely advanced from any position.

A further object of this invention is to provide an improved quick-action bar clamp wherein the moving jaw may be advanced in increments of selectable length for each action of a driving handle.

Yet another object of this invention is to provide an improved quick-action bar clamp wherein the movable jaw does not move under its weight when the clamp is in a vertical position.

Still another object of this invention is to provide an improved quick-action bar clamp wherein clamp operation is accomplished with one hand.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 5 is a view similar to FIG. 1 of an alternative embodiment of a quick-action bar clamp in accordance with the invention;

FIG. 6 is a section view taken along the line 6—6 of FIG. 5;

FIG. 7 is a sectional view taken along the line 7—7 of FIG. 5;

DESCRIPTION OF THE PREFERRED EMBODIMENT

Figure 1:
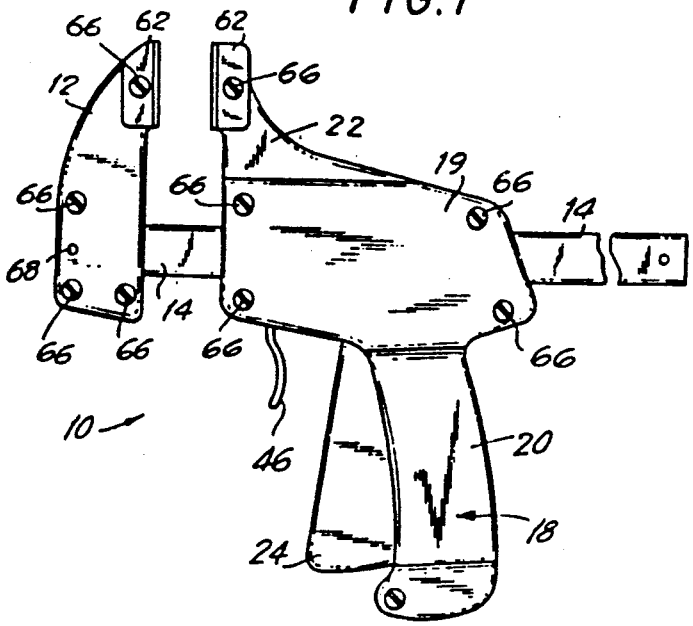
FIG. 1 is a front view of a quick-action bar clamp in accordance with the invention.

With reference to the Figures, a quick-acting bar clamp 10 includes a movable jaw 12 connected to a slide bar 14. The slide bar is slidably supported in a slot 16 (FIG. 4) which passes through a handle/grip assembly 18.

The handle/grip assembly 18 includes a body 19 through which the slot 16 passes, a handgrip 20 attached to the body 19 on one side of the slot 16, and a fixed jaw 22 attached to the body 19 on the other side of the slot 16. A trigger handle 24 is pivotably mounted to the body 19 adjacent the slot 16 by means of a pivot pin 26. The moving jaw 12 opposes the fixed jaw 22.

Figure 4:
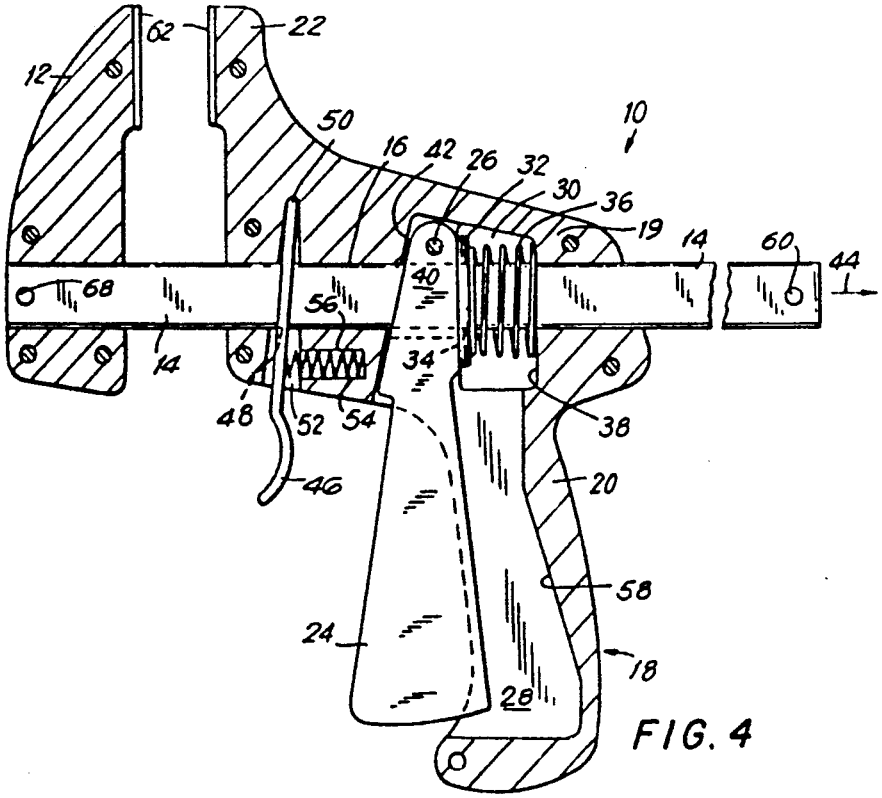
FIG. 4 is a sectional view to an enlarged scale taken along the line 4—4 of FIG. 3.

As best illustrated in FIG. 4, the handle grip 20 is hollow in part so as to receive the trigger handle in the cavity 28. A second cavity 30 in the body 19 divides the slot or bore 16. A driving lever 32 is suspended on the slide bar 14 which passes through a hole 34 in the driving lever 32. A spring 36 is compressed between the driving lever 32 and a surface 38 of the cavity 30 urging the driving lever 32 against the upper end 40 of the trigger handle 24. The upper end 40 of the trigger handle 24 is forked and straddles the slide bar 14. Force of the spring 36 urges the trigger handle 24 against an inner surface 42 of the body 19 thus providing a standby condition. In the standby condition, the driving lever 32 is positioned perpendicular to the direction of motion, indicated by the arrow 44, of the slide bar 14 when in operation. Any motion of the handle 24 about the pivot pin 26 in the direction of the arrow 44 is accomplished against the bias of the spring 36.

A braking lever 46 is suspended form the slide bar 14 which passes through an opening 48 in the braking lever 46. One end 50 of the braking lever 46 is pivotably captured in a recess 52 within the body 19 such that the braking lever 46 may pivot within constraints defined by the surfaces of the recess 52 and by binding of the braking lever 46 with the slide bar 14 when the edges of the opening 48 in the lever 46 engage the surface of the slide rod 14. A spring 54 seats in a recess 56 in the body 19 and biases the free end of the braking lever 46 away from the trigger handle 24. The biased position of the braking lever 46 is limited by the binding interference between the opening 48 of the lever 46 with the slide bar 14.

It should be noted that in the standby position illustrated in FIG. 4, the driving lever 32 is substantially perpendicular to the longitudinal axis of the slide bar 14, whereas the portion of the braking lever 46 which engages the slide bar 14 is transverse to the longitudinal axis of the bar 14 but not perpendicular thereto In this condition, if a force is applied to the moving jaw 12 in the direction indicated by the arrow 44, the slide bar 14 is free to move through the hole 34 in the driving lever 32 and through the spring 36. Because the braking lever 46 is free to pivot against the bias of the spring 54 when force is applied on the moving jaw 12 in the direction of the arrow 44, the braking lever 46 presents no obstacle to this motion of the slide bar and the moving jaw 12 may be advanced continuously toward the fixed jaw 22.

However, in the standby position as illustrated in FIG. 4, if a force is applied to the movable jaw 12 in the direction opposite to the direction indicated by the arrow 44, the edges of the opening 48 in the lever 46 bind against the surface of the slide bar 14 and it is not possible, without further action, to withdraw the moving jaw farther away from the fixed jaw 22, as described more fully hereinafter. Compression of the spring 56 by pressing on the braking lever 46 in the direction of the arrow 44, allows withdrawal of the slide bar 14 and movable jaw 12 away from the fixed jaw 22. This force brings the end 50 of the lever 46 into perpendicularity with the direction of intended motion of the slide bar 14. Then the slide bar 14 is free to slide in either direction through the opening 48 in the braking lever 46.

The trigger handle 24 is squeezed in the direction indicated by the arrow 44 to incrementally advance the slide bar 14 with its attached movable jaw 12 toward the fixed jaw 22. When the handle 24 is squeezed between a user's hand (not shown) and the handgrip 20, pivoting occurs about the pivot pin 26 and the end 40 of the trigger handle 24 moves in the direction of the arrow 44. This causes the driving lever 32 to pivot about its upper end (FIG. 4), so that the driving lever 32 is no longer perpendicular to the direction 44 of intended motion of the slide bar 14. Pivoting the driving lever 32 compresses the spring 36 and also causes the edges of the hole 34 through the driving lever 32 to bind against the surface of the slide rod 14. Binding occurs because the driving lever 32 is no longer perpendicular to the direction 44 of intended motion of the slide bar 14. Further motion of the trigger handle 24 causes the driving lever 32 to translate in the direction of the arrow 44. This motion further compresses the spring 36 and in the process, by means of the binding interference between the lever 32 and bar 14, advances the bar 14 and its connected movable jaw 12 toward the fixed jaw 22. The maximum distance of advance of the movable jaw 12 with one stroke of the trigger handle 22 is limited when the spring 36 is fully compressed or, in an alternative construction, the handle 24 strikes the inner surface 58 of the handgrip 20.

However, the stroke of the trigger handle 24 can be through any lesser arc, thereby diminishing the distance the movable jaw 12 travels in a single stroke in proportion to the angle of the trigger handle stroke Additional strokes may be applied to the trigger handle 42 of any magnitude until the jaw 12, 22 come together, or a workpiece (not shown) is firmly gripped between them.

After the trigger handle 24 is fully pivoted in the direction of the arrow 44 about the pivot pin 26, release of the trigger handle 24 causes the return of the trigger handle 24, driving lever 32 and spring 36 to the position shown in FIG. 4 as a result of the compressive forces in the spring 36 urging the components toward the movable jaw 12.

A transverse pin 60 passing through the free end of the slide bar 14 prevents withdrawal of the slide bar 14 from the slot 16 when the braking lever 46 is pressed in the direction of the arrow 44 and the movable jaw 12 is manually drawn away from the fixed jaw 22. It should be noted that operation of the trigger handle 24 is ineffective in accomplishing any motion of the slide bar 14 in the direction opposite to the arrow 44.

For illustrative purposes only, protective pads 62 are shown attached to the jaws 12, 22. Also for illustrative purposes, the moving jaw 12 and the handle/grip assembly 18 are formed of halves which are held together by screws 66. The moving jaw 12 is held to the slide bar 14 by a pin 68. In the illustrated embodiment (FIG. 4) in accordance with the invention, the slide bar 14 has a rectangular cross-section. In alternative embodiments in accordance with the invention, the slide bar 14 may be any shape, for example , square, round, triangular, and the openings 34, 48 in the levers 32, 46, respectively are appropriately shaped for proper binding interference with the slide bar 14.

In summary, if it is considered that a workpiece is to be clamped between the jaws 12, 22, the movable jaw 12 can be advanced toward the fixed jaw 26 either in one continuous motion, merely by pushing in the direction of the arrow 44 on the movable jaw 22 or, by operating the trigger handle 24 in a series of strokes of length to be determined by the user. Large strokes may be used at first and small strokes later as the desired pressure is applied to the workpiece. During this advancing operation, the braking lever 46 prevents any backward motion of the slide bar 14 after each advance has been completed. While the braking lever 46 holds the bar 14, the trigger handle 24 is released. The spring 36 then returns the handle 24 and driving lever 32 to the positions shown in FIG. 4, ready for another stroke. At any time when the user desires to retract the movable jaw 12 away from the fixed jaw 22, for example, to release a workpiece or to open the bar clamp to receive a workpiece, it is only necessary to pull on the movable jaw 12 in the direction opposite to the arrow 44 while simultaneously compressing the spring 54 by pressing on the braking lever 46 in the direction of the arrow 44.

It should be noted that all operations of the trigger handle 24 and braking lever 46 can be accomplished with the same hand while holding the bar clamp 10 with that hand. Either the index or middle finger is in position to actuate the braking lever 46 as required while the other fingers encircle and contain the trigger handle 24 and handgrip 20.

Figure 2:
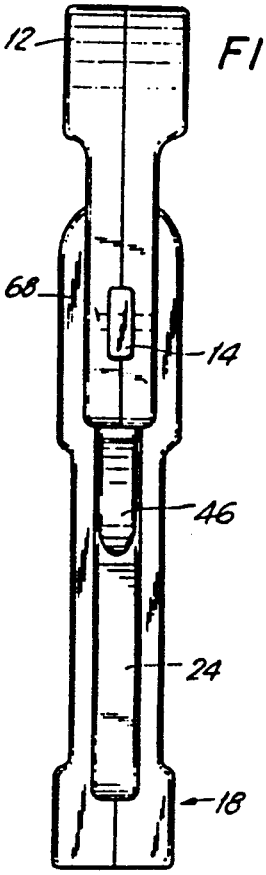
FIG. 2 is a left end view to an enlarged scale of the quick-action bar clamp of FIG. 1.
Figure 3:
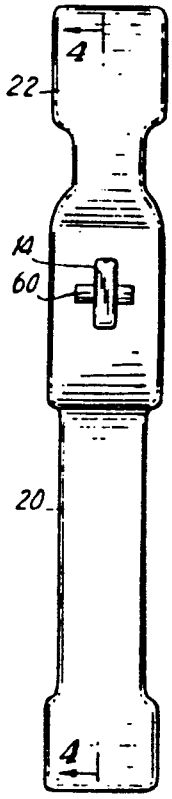
FIG. 3 is a right end view to an enlarged scale of the quick-action bar clamp of FIG. 1.

As best illustrated in FIGS. 2 and 3, the overall quick-action bar clamp 10 in accordance with the invention is basically flat, takes little space, and can be operated in tight places. Slide bars 14 of different lengths may be used.

In FIGS. 1–4, the handle/grip assembly 18 is formed of halves which are held together by screws 66 and the trigger handle 24 is solid and slips into the cavity 28 in the handgrip 20. In an alternative embodiment (FIGS. 5–7), a quick-action bar clamp 110 in accordance with the invention includes a one-piece handle/grip assembly 118, which includes no internal recess, and a basically U-shaped trigger handle 124. When the trigger handle 124 squeezed against the handgrip 120, as will be apparent in FIG. 7, the handle 124 moves in the direction of the arrow 144 and straddles the handgrip 120. The end 150 of the braking lever 146 pivots in a recess 152 in the handle/grip assembly body 199. The trigger handle 124 pivots about an axis 126 and includes semi-circular tabs 170 which are recessed into correspondingly shaped slots 172 in the body 119

Figure 8:
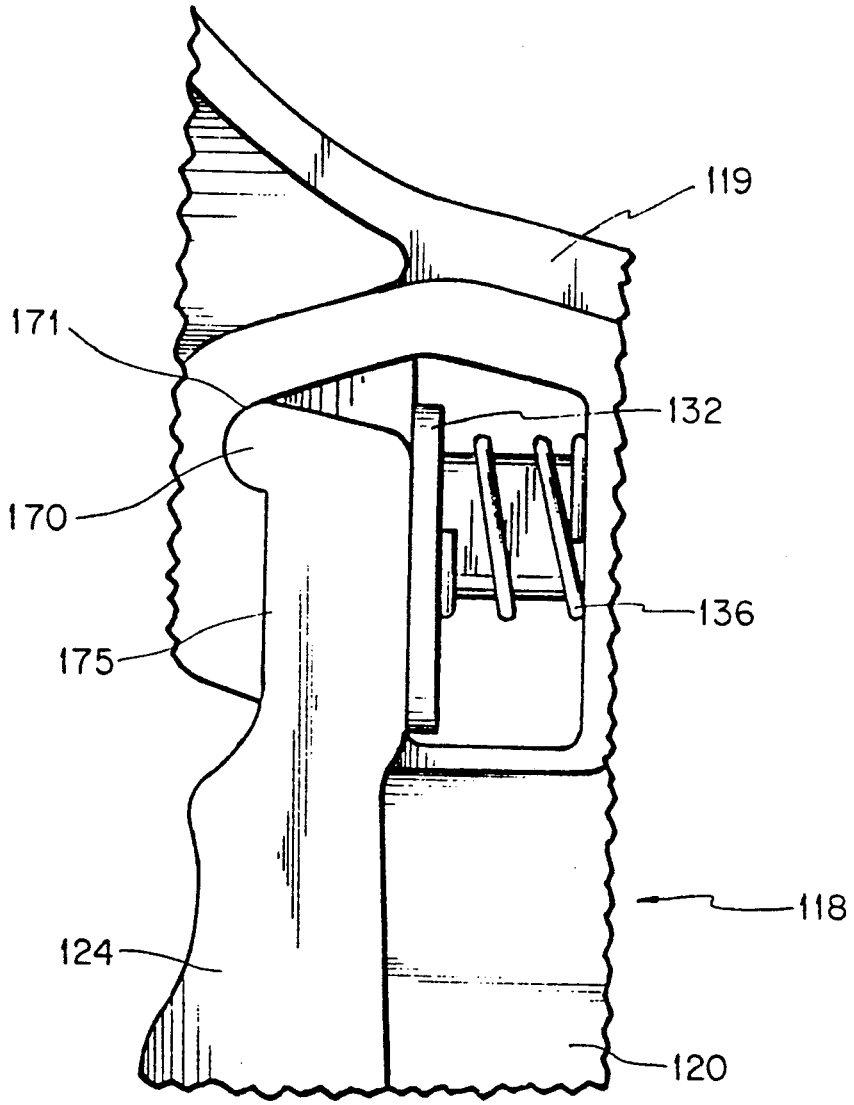
FIG. 8 is a partial view of another embodiment of the bar clamp.

A slightly modified embodiment of the bar clamp is shown in FIG. 8. There, the tabs 170 are retained in recesses 171 by the pressure of the spring 136 and the .driving lever 132. Such arrangement substantially simplifies a process of assembly of the bar clamp as well as the replacement of the trigger handle. To install the trigger handle 124 onto the assembly 118 end, and of the trigger handle having the tabs 170 is initially inserted between the driving lever 132 and a guide 175 of the body 119. Then, the trigger handle is pushed until the tabs 170 are engaged with the recesses 171 and the driving lever secures that position.

Figure 9:
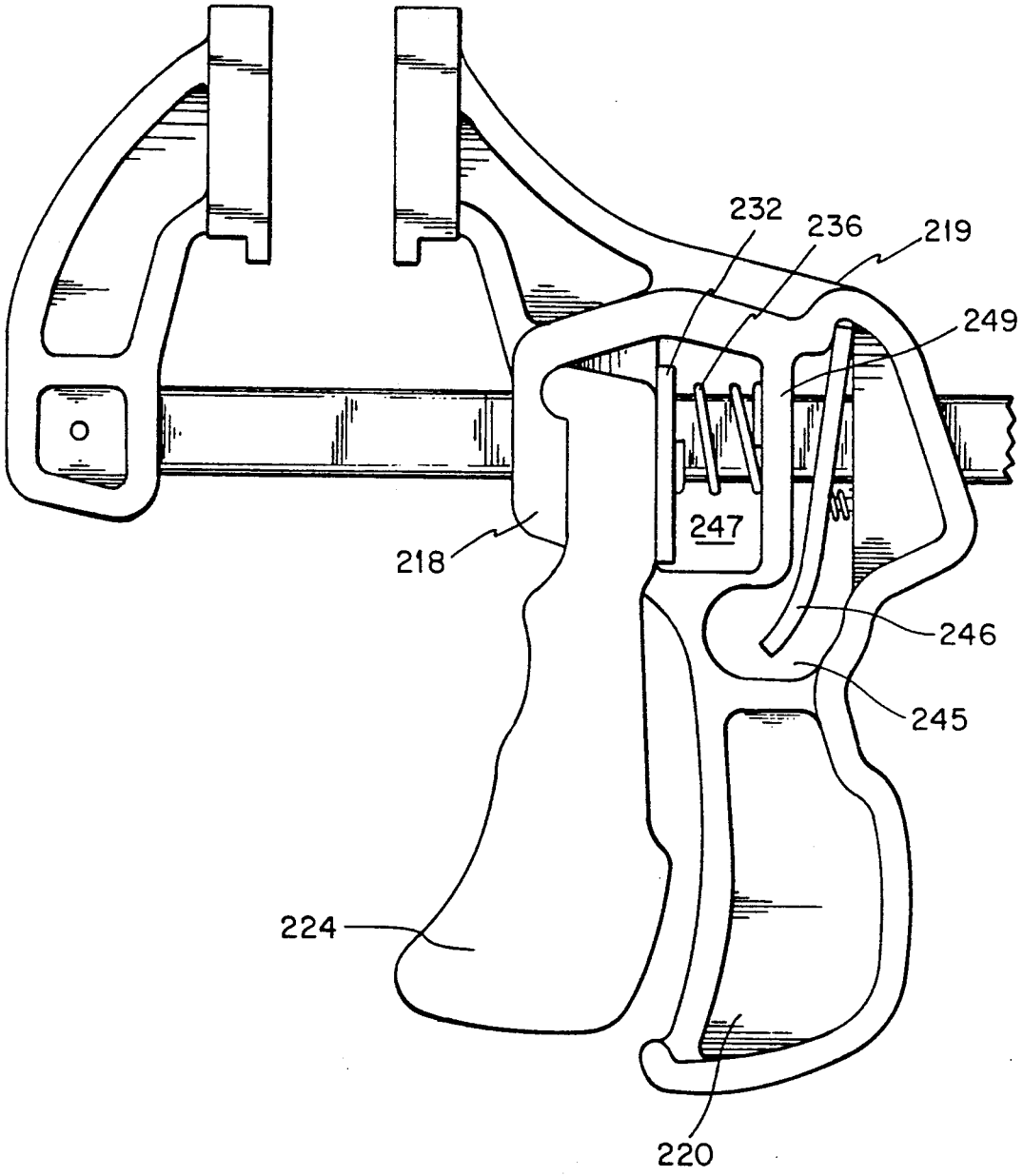
FIG. 9 is an elevational view of a further embodiment of the bar clamp.

FIG. 9 best illustrates that a body 219 of an assembly 218 has a driving chamber 247 with a driving lever 232 and a spring 234, and a braking chamber having a braking lever 246. The braking lever 246 is positioned above a handle 220 and behind a trigger 224. The making chamber 245 is isolated from the driving chamber 247 by a separating member 249. One end 250 of the braking lever is pivotally positioned in a recess 252 situated near an upper part of the body 219. The use of the embodiment shown in FIG. 9 is especially recommended in the situation where preventing of inadvertent activation of the braking lever is desired.

In the embodiment of FIG. 1, the movable jaw 12 and the fixed jaw 22 are positioned on one side of the support assembly 18 and face each other. Therefore, activation of the driving lever 32 by the trigger handle 24 moves the slide bar 14 and the jaw 12 in the direction of the fixed jaw.

Figure 10:
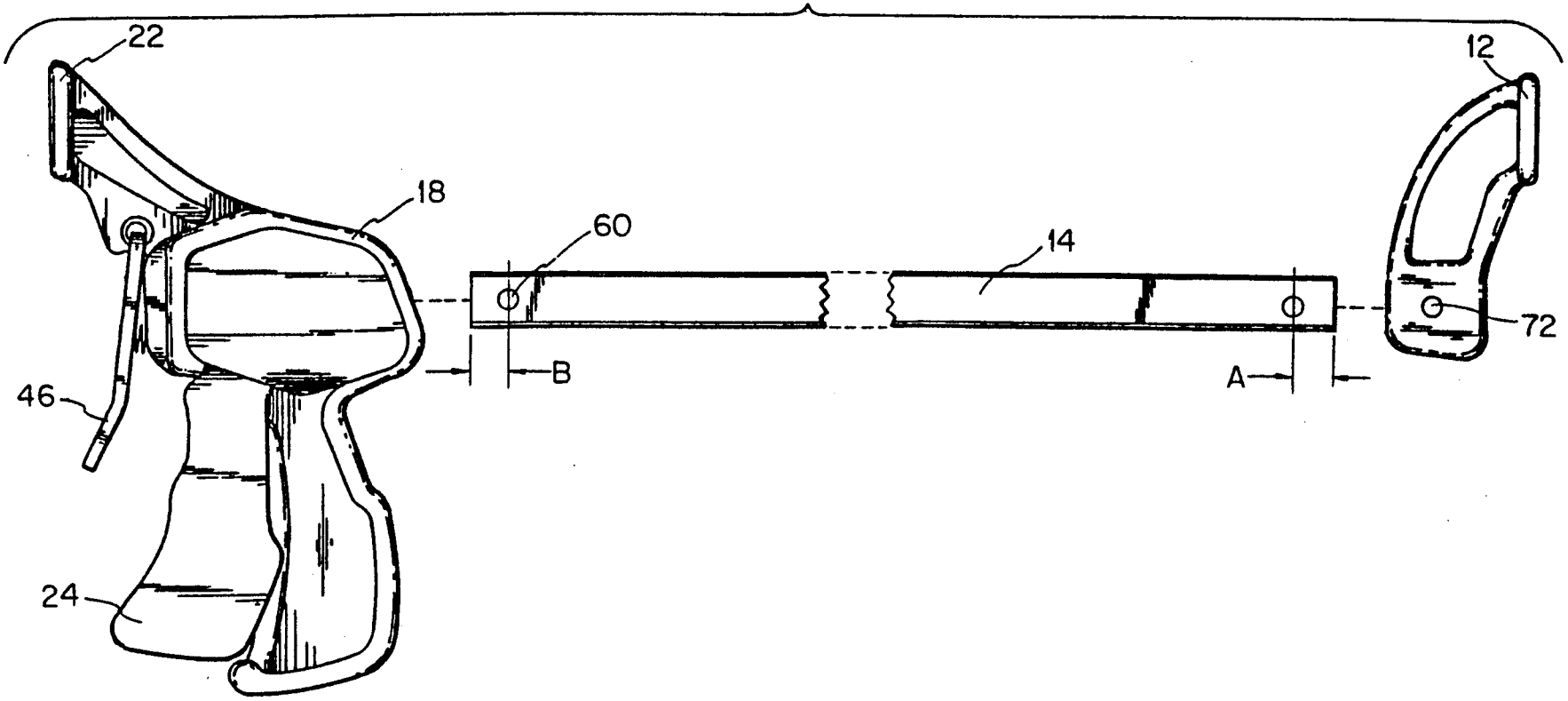
FIG. 10 is an exploded view of the element of the bar clamp shown in FIG. 1.
Figure 11:
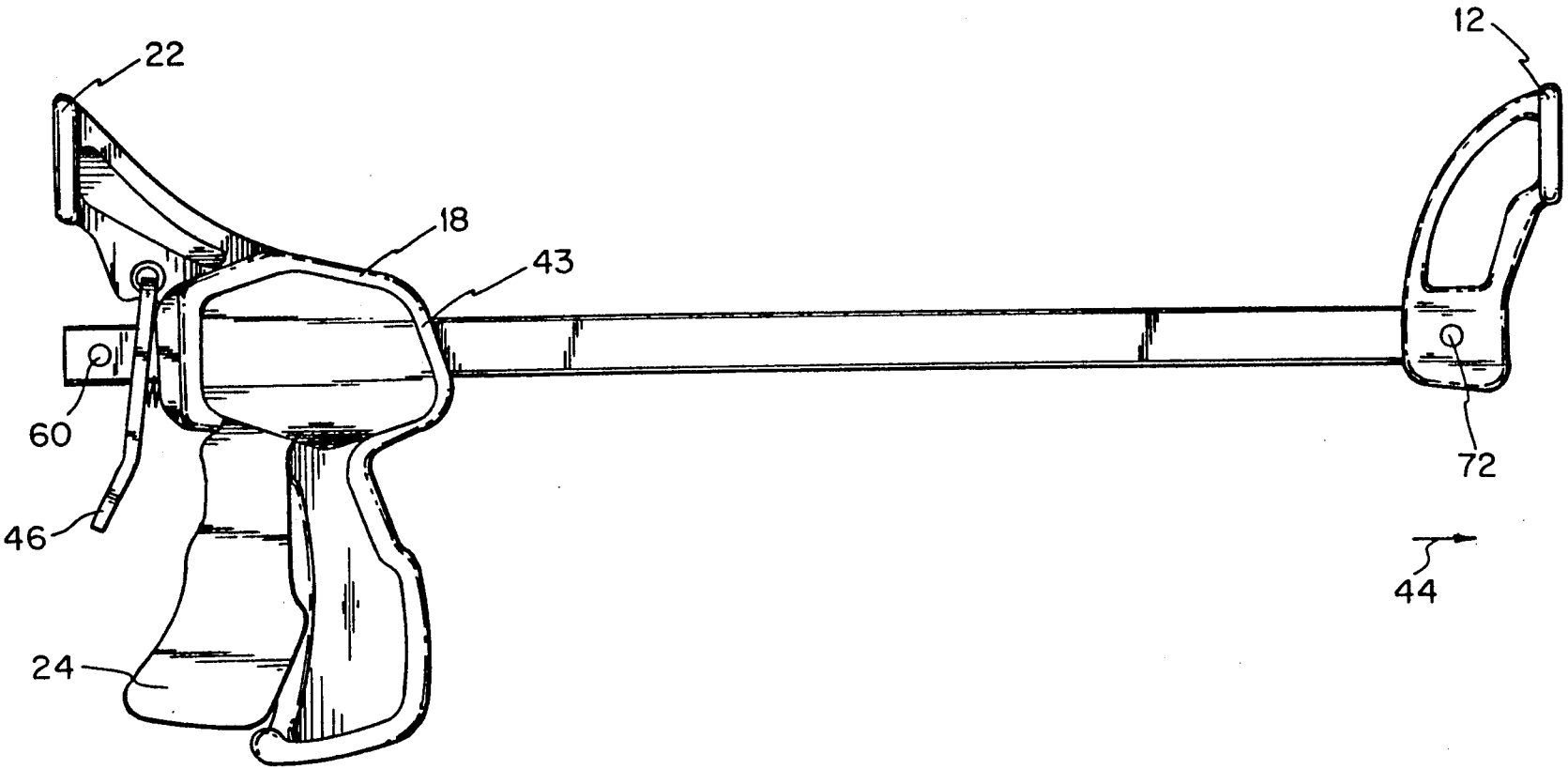
FIG. 11 is a still further embodiment of the invention.

A modified bar clamp or a hand tool having the fixed jaw 22 and movable jaw 12 facing in opposite directions and extending from opposite sides of the assembly 18 is best shown in FIGS. 10 and 11. In this embodiment the slide bar is inserted into the support assembly in such a way that the stop 60 positioned at one end thereof faces the braking lever 46 and the movable jaw 12 positioned at the other end of the slide bar faces the rear portion 43 of the support assembly.

In operation of this embodiment, when the trigger handle 24 is squeezed it activates the driving lever (not shown in FIG. 10 and 11) and incremently advances the movable jaw 12 conneced to the slide bar 14 away from the fixed jaw 22.

In the standby position, the braking lever 46 engaging the slide bar 14 is transversely oriented to the slide bar at a slight angle. If a force is applied to the movable jaw in the direction of the arrow 44, the braking lever 46 presents no obstacle to the motion of the slide bar. However, if a force is applied to the movable jaw 12 in the direction opposite to the direction of the arrow 44, the engagement of the lever 46 and the surfaces of the slide bar 14 makes it impossible to withdraw the movable jaw 12 further away from the fixed jaw 22.

If it is desired that a workpiece is to be spread apart by the jaws 12 and 22, the movable jaw 12 is advanced away from the jaw 22 by activation of the trigger handle and driving lever.

Typically, the movable jaw is permanently mounted at one end of the slide bar, whereas the stop is fixedly positioned at the other end. However, if desired, the movable jaw 12 can be connected to the slide bar by means of a screw 72 or by any other suitable fastening means. The stop 60 can also be attached to the slide bar by a thread or any other conventional means to facilitate its removal and/or replacement.

In this case, the hand tool shown in FIG. 1, having jaws facing each other, can easily be converted into the hand tool illustrated in the embodiment of FIG. 9 with the jaws facing in opposite directions. Steps of such, conversely are illustrated in FIG. 10.

In order to convert the tool, the screw connecting the movable jaw to the slide bar is loosened and the jaw removed from the bar.

Then, the stop is likewise released and taken out. The movable jaw 12 is then positioned on the bar as illustrated in FIG. 11 into an opening in the slide bar facing the braking lever. In this case, the threads of the openings in the slide bar which are adapted for the attachment of the removable jaw 12 and the stop 60 are compatible and generally positioned at equal distances (A and B) from the corresponding ends of the slide bar.

Figure 12:
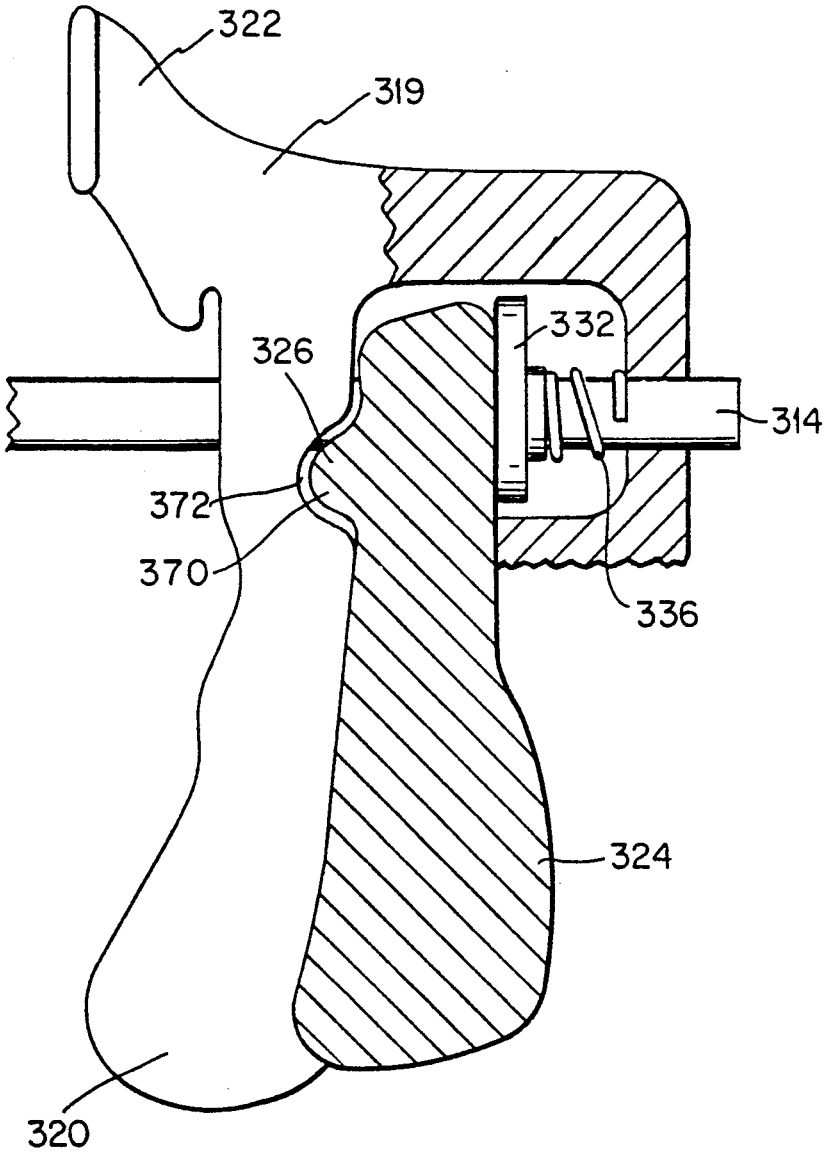
FIG. 12 is a partial cross-sectional view of a new embodiment of the invention.

In FIG. 12 positioning of a trigger handle 324 rearwardly of a stationary handle 320 is illustrated. The trigger handle pivots about an axis 326 and is provided with projected tabs 370 which are recessed in correspondingly shaped projections 372 in the body 319.

During opration, fingers of one hand of a user surround the handle 320 while the trigger 324 is activated by the palm of the same hand.

Figure 13:
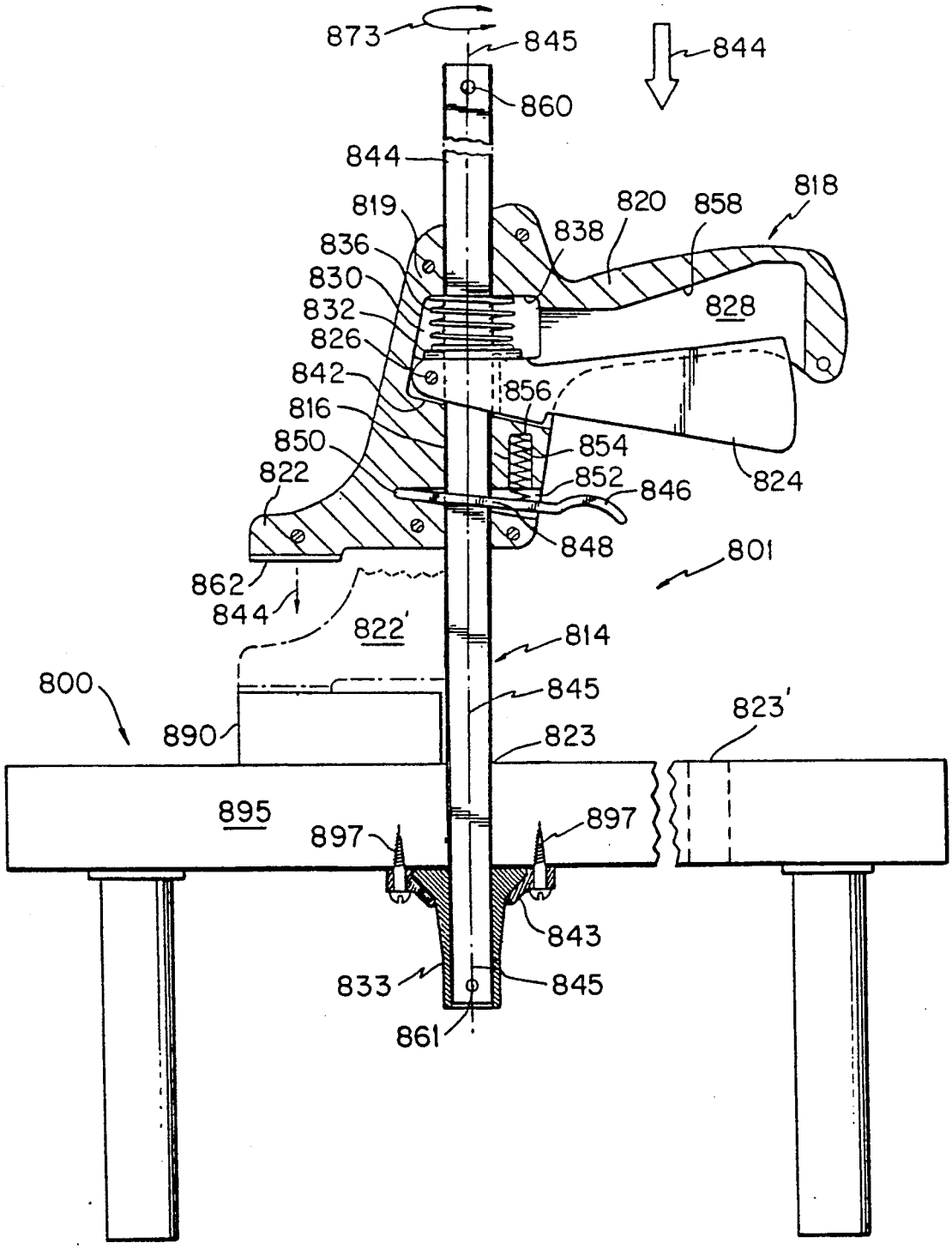
FIG. 13 is an elevational view of a still further embodiment of the present invention in the form of a clamp jaw in combination with a substrate.
Figure 14:
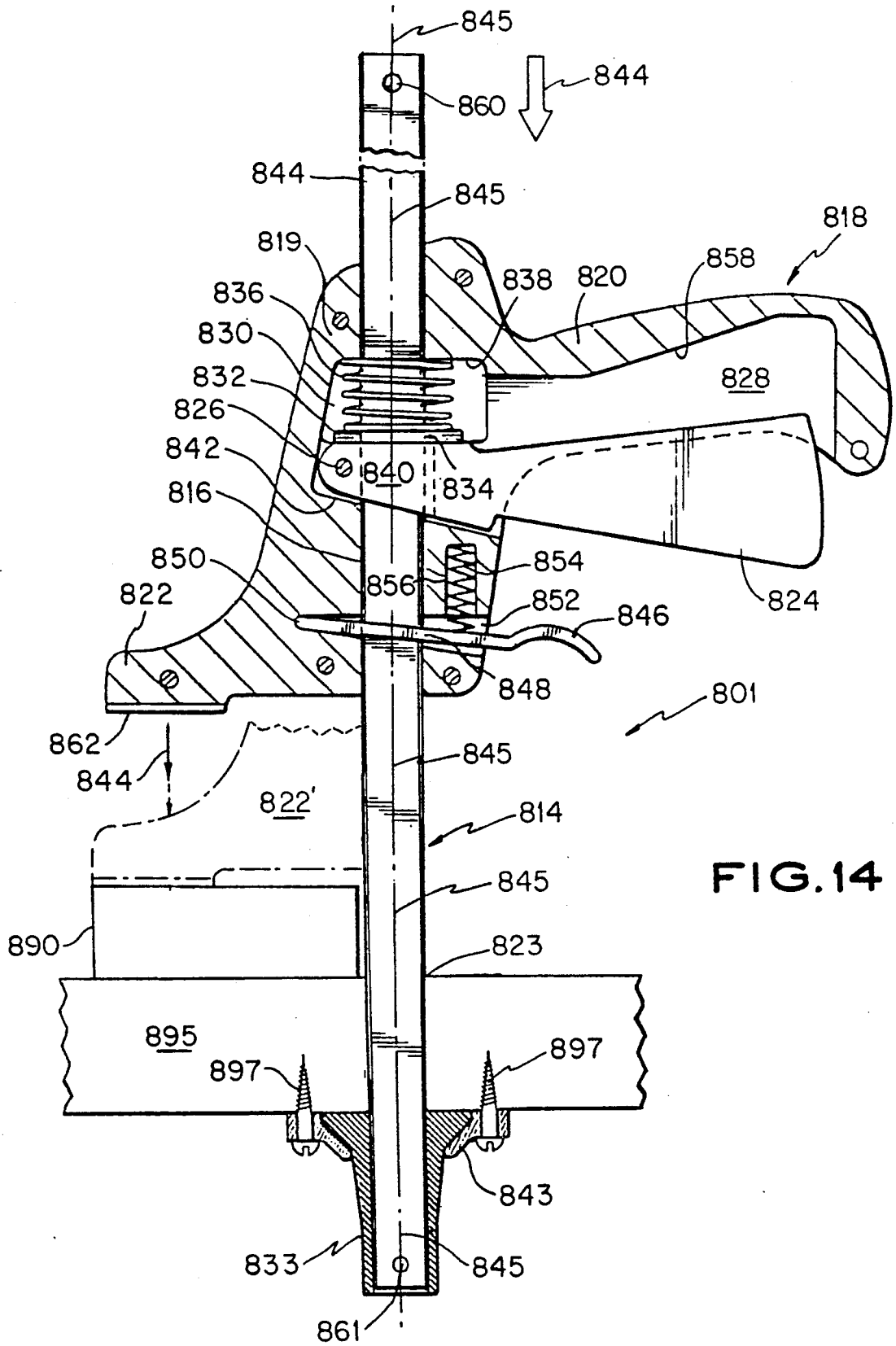
FIG. 14 is an elevational view showing the clamp jaw of FIG. 13.

With reference to FIGS. 13 and 14 which shows a particular embodiment of the hold down clamp system of the present invention, there is no movable jaw attached to the slide bar 814 and slide bar 814 is engaged with the cross-piece support 895 of saw horse 800. In FIG. 13 slide bar 814 passes through pre-cut hole 823 in cross-piece substrate 895 and is fixedly engaged to a rotatable hub 833 which is rotatable within flanged housing 843 which is connected to the substrate 895 at 897. Thus, the slide bar 814, of which a substantial portion extends away from the substrate 895 and the housing 843, is rotatable, as shown at 873 (see FIG. 15), about its longitudinal axis so that it can conveniently engage a workpiece 890 without requiring substantial movement of the workpiece 890.

In the embodiment of FIG. 14, it will be noted that, in contrast to the operation of the embodiment of FIG. 4, a clamp jaw 822 affixed to a handle assembly 818 moves towards the substrate 895 and the workpiece 890 as indicated at 844, while a slide rod 814 remains stationary. The clamp jaw 822 can be slidably moved along slide bar 814 to position the clamp jaw 822' closely abutting the workpiece 890 and then further advanced and tightened against the workpiece 890 by operation of the trigger handle/grip 818. A braking lever 846, biased to bind against the slide bar 814 prevents movement of the clamp jaw 822 away from the workpiece 890 except when it is disengaged from the bar 814. The trigger handle assembly 818 advances the clamp jaw 822 by actuating the driving lever 832 which binds against surfaces of the slide bar 814. The driving lever 832, is returned by force of a compressed spring 836 to its original position after each stroke of the trigger handle 824.

Figure 15:
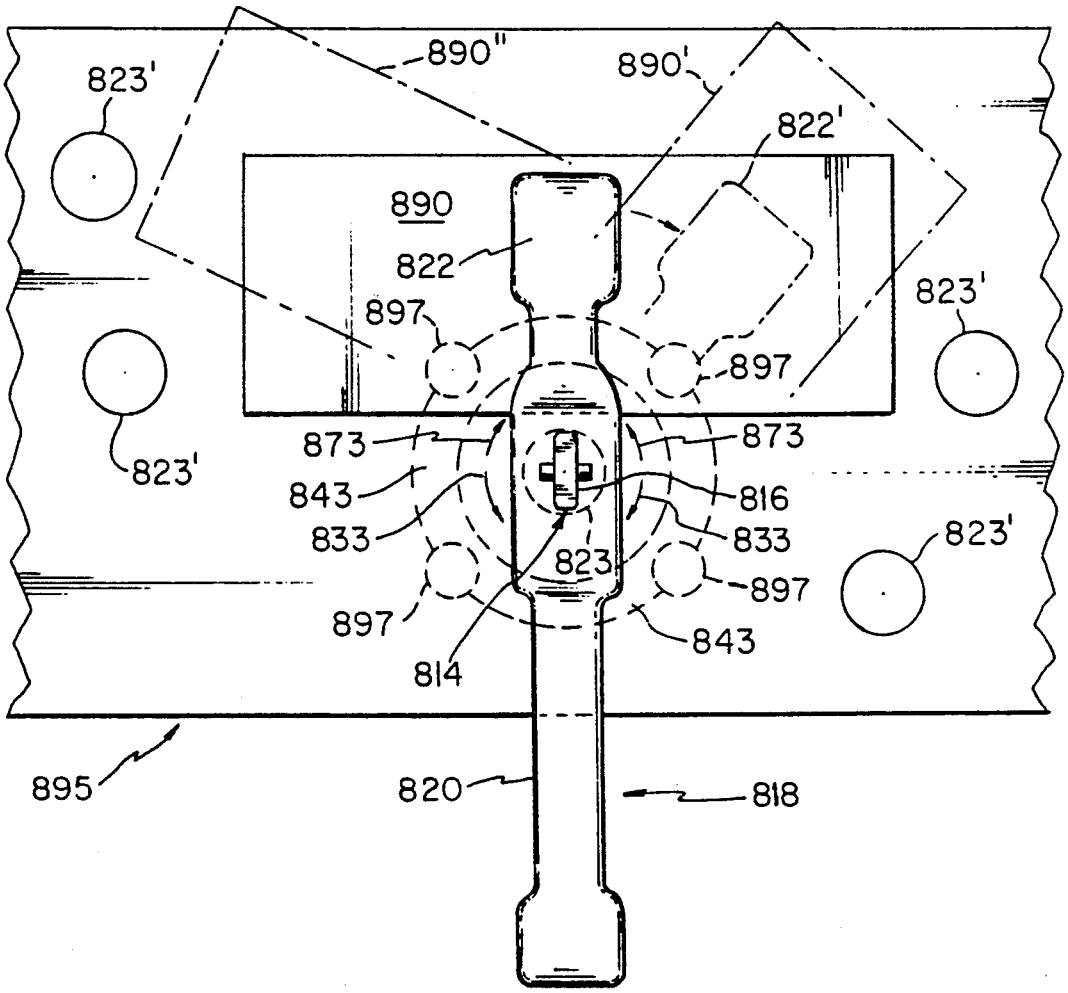
FIG. 15 is a plan view illustrating an operation of the clamp jaw of FIG. 14.

With reference to FIGS. 13–15, the hold down clamp system 801 of the present invention includes a slide bar 814 which is slidably engaged in a slot 816 which passes through a handle/grip assembly 818. The slide bar 814 is fixed at a transverse pin 861 to a rotatable hub 833 which is seated in a retaining flange 843. The flange 843 is fixed to the substrate 895 at threaded members 897. The aforedescribed arrangement enables the rotating of the slide bar 814, clamp jaw 822 and handle/grip assembly 818 to which slide bar 814 is slidably engaged. By rotating the slide bar 814 and clamp jaw 822 as indicated at 873 in FIG. 15, different positions of workpiece 890, indicated exemplarily at 890', 890'' can be readily accommodated. Also, additional apertures 823' can be provided in the substrate 895 so that slide rod 814 can also be engaged to the substrate 895 at these locations to accommodate articles of different shapes and different positions.

The handle/grip assembly 818 includes a body 819 through which the slot 816 passes, a handgrip 820 attached to the body 819 on one side of the slot 816, and a clamp jaw 822 attached to the body 819 on the other side of the slot 816. In one embodiment of the invention, a trigger handle 824 can be pivotably mounted to the body 819 adjacent to the slot 816 by means of a pivot pin 826. The clamp jaw 822 opposes the substrate 895.

As best illustrated in FIG. 14, the handle grip 820 is hollow in part so as to receive the trigger handle in the cavity 828. A second cavity 830 in the body 819 divides the slot or bore 816. A driving lever 832 abuts the slide bar 814 which passes through a hole 834 in the driving lever 832. A spring 836 is compressed between the driving lever 832 and a surface 838 of the cavity 830 urging the driving lever 832 against the upper end 840 of the trigger handle 824. The end 840 of the trigger handle 824 adjacent pivot pin 826 is forked and straddles the slide bar 814. Force of the spring 836 urges the trigger handle 824 against an inner surface 842 of the body 819 thus providing a standby condition. In the standby condition, the driving lever 832 is positioned perpendicular to the longitudinal axis 845 of slide bar 814 and the direction of motion of handle/grip 818 and clamp jaw 822 fixed thereto, indicated by the arrow 844, when in operation. Any motion of the trigger handle 824 about the pivot pin 826 opposite to the direction of the arrow 844 is accomplished against the bias of the spring 836.

A braking lever 846 abuts the slide bar 814 which passes through an opening 848 in the braking lever 846. One end 850 of the braking lever 846 is pivotably captured in a recess 852 within the body 819 such that the braking lever 846 may pivot within constraints defined by the surfaces of the recess 852 and by binding of the braking lever 846 with the slide bar 814 when the edges of the opening 848 in the lever 846 engage the surface of the slide rod 814. A spring 854 seats in a recess 856 in the body 819 and biases the free end of the braking lever 846 away from the trigger handle 824. The biased position of the braking lever 846 is limited by the binding interference between the opening 848 of the lever 846 with the slide bar 814.

It should be noted that in the standby position illustrated in FIG. 14, the driving lever 832 is substantially perpendicular to the longitudinal axis 845 of the slide bar 814, whereas the portion of the braking lever 846 which engages the slide bar 814 is transverse to the longitudinal axis 845 of the bar 814 but not perpendicular thereto. In this condition, if a force is applied to the handle/grip 818 and clamp jaw 822 affixed thereto in the direction indicated by the arrow 844, the clamp jaw 822 freely moves along slide bar 814 which passes through the hole 834 in the driving lever 832 and through the spring 836. Because the braking lever 846 is free to pivot against the bias of the spring 854 when force is applied on the handle/grip 818 and clamp jaw 822 in the direction of the arrow 844, the braking lever 846 presents no obstacle to this motion of handle/grip 818 and clamp jaw 822 affixed thereto, clamp jaw 822 may be advanced continuously toward the substrate 895.

However, in the standby position as illustrated in FIG. 14, if a force is applied to handle/grip 818 and clamp jaw 822 affixed thereto in the direction opposite to the direction indicated by the arrow 844, the edges of the opening 848 in the lever 846 bind against the surface of the slide bar 814 and it is not possible, without further action, to withdraw the clamp jaw 822 and its supporting assembly 818 farther away from the substrate 895, as described more fully hereinafter. Compression of the spring 854 by pressing on the braking lever 846 in the direction opposite to the arrow 844, allows withdrawal of the clamp jaw 822 away from the substrate 895. This force brings the lever 846 into perpendicularity with the longitudinal axis 845 of slide bar 814 and the direction of intended motion 844 of handle/grip 818 and clamp jaw 822. Then the handle/grip 818 and clamp jaw 822 are free to slide in either direction, up or down.

The trigger handle 824 is squeezed opposite to the direction indicated by the arrow 844 to incrementally advance the clamp jaw 822 affixed to handle/grip 818 along slide bar 814 toward the substrate 895. When the handle 824 is squeezed between a user's hand (not shown) and the handgrip 820, pivoting occurs about the pivot pin 826 and the end 840 of the trigger handle 824 moves opposite to the direction of the arrow 844. This causes the driving lever 832 to pivot about its end adjacent to pivot pin 826 (FIG. 14), so that the driving lever 832 is no longer perpendicular to the direction 844 of intended motion of handle/grip 818 and clamp jaw 822 and the longitudinal axis 845 of the slide bar 814. Pivoting the driving lever 832 compresses the spring 836 and also causes the edges of the hole 834 through the driving lever 832 to bind against the surfaces of the slide rod 814. Binding occurs because the driving lever 832 is no longer perpendicular to the direction 844 of intended motion of handle/grip 818 and clamp jaw 822 and its longitudinal axis 845 of the slide bar 814. Further motion of the trigger handle compresses the spring 836 and in the process, by means of the binding interference between the lever 832 and slide bar 814, advances the handle/grip 818 and its connected clamp jaw 822 toward the substrate 895. The maximum distance of advance of the clamp jaw 822 with one stroke of the trigger handle 824 is limited when the spring 836 is fully compressed or, in an alternative construction, the handle 824 strikes the inner surface 858 of the handgrip 820.

However, the stroke of the trigger handle 824 can be through any lesser arc, thereby diminishing the distance the clamp jaw 822 travels in a single stroke in proportion to the angle of the trigger handle stroke. Additional strokes may be applied to the trigger handle 824 of any magnitude until the clamp jaw 822 contacts substrate 895, or a workpiece 890 is firmly gripped between clamp jaw 822 and substrate 895.

After the trigger handle 824 is fully pivoted opposite to the direction of the arrow 844 about the pivot pin 826, release of the trigger handle 824 causes the return of the trigger handle 824, driving lever 832 and spring 836 to the position shown in FIG. 14 as a result of the compressive forces in the spring 836 urging the components in the direction 844 toward the substrate 895.

A transverse pin 860 passing through the free end of the slide bar 814 prevents undesired removal of clamp jaw 822 from the slide bar 814 when the braking lever 846 is pressed in the direction opposite to the arrow 844, and the clamp jaw 822 is manually drawn away from the substrate 895. It should be noted that operation of the trigger handle 824 is ineffective in accomplishing any motion of the handle/grip 818 and clamp jaw 822 in the direction opposite to the arrow 844.

For illustrative purposes only, protective pads 862 are shown attached to the jaw 822. Also for illustrative purposes, in some embodiments of the invention, the handle/grip assembly 818 is formed of halves which are held together by screws. The rotatable hub 833 is held to the slide bar 814 by a pin 861. In the illustrated embodiment (FIG. 14) in accordance with the invention, the slide bar 814 has a rectangular cross-section. In alternative embodiments in accordance with the invention, the slide bar 814 may be any shape, for example, square, round, triangular, and the openings 834, 848 in the levers 832, 846, respectively are appropriately shaped for proper binding interference with the slide bar 814.

In summary, if it is considered that a workpiece 890 is to be clamped between clamp jaw 822 and substrate 895, the clamp jaw 822 can be advanced toward the substrate 895 either in one continuous motion, merely by pushing in the direction of the arrow 844 on the handle/grip 818 or, by operating the trigger handle 824 in a series of strokes of length to be determined by the user. Large strokes may be used at first and small strokes later as the desired pressure is applied to the workpiece 890. During this advancing operation,, the braking lever 846 prevents any reverse motion of the clamp jaw 822 after each advance has been completed. While the braking lever 846 holds the bar 814, the trigger handle 824 is release . The spring 836 then returns the handle 824 and driving lever 832 to the positions shown in FIG. 14, ready for another stroke. At any time when the user desires to retract the clamp jaw 822 away from the substrate 895, for example, to release a workpiece or to open the bar clamp to receive a workpiece, it is only necessary to pull on the handle/grip 818 in the direction opposite to the arrow 844 while simultaneously compressing the spring 854 by pressing on the braking lever 846 opposite to the direction of the arrow 844.

It should be noted that all operations of the trigger handle 824 and braking lever 846 can be accomplished with one hand while holding the handle/grip 818 with said hand. Either the index or middle finger is in position to actuate the braking lever 846 as required while the other fingers encircle and contain the trigger handle 824 and handgrip 820.

Figure 16:
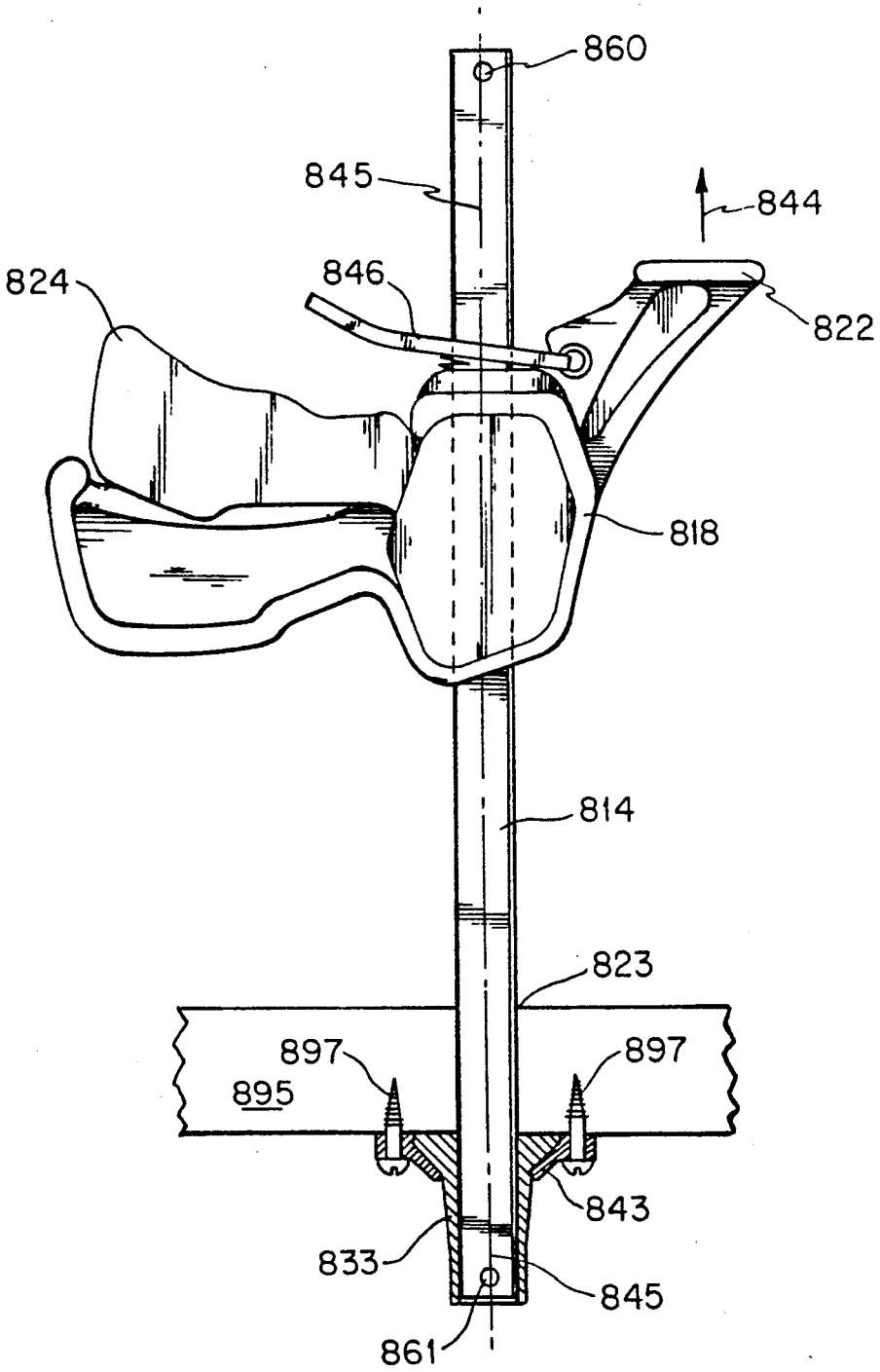
FIGS. 16 and 17 are elevational views illustrating the embodiment of FIG. 13 converted to a spreading tool.

A modified bar clamp or a hand tool having the clamp jaw 822 facing away from substrate 895 in opposite directions and extending from opposite sides of the assembly 818 is shown in FIG. 16. In this embodiment the slide bar 814 is engaged with substrate 895 in the same manner as in FIG. 14 and handle 18 and clamp jaw 822 are positioned on slide bar 814 to face away from substrate 895.

In operation of this embodiment, when the trigger handle 824 is squeezed it activates the driving lever ,not shown in FIGS. 11 and 12) and incrementally advances the clamp jaw 822 and handle/grip 818 along slide bar 814 away from the substrate 895.

In the standby position, the braking lever 846 engaging the slide bar 814 is transversely oriented to the slide bar 814 at a slight angle. If a force is applied to the clamp jaw 822 in the direction of the arrow 844, the braking lever 846 presents no obstacle to the motion of clamp jaw 822 and handle/grip 818 along the slide bar 814. However, if a force is applied to the clamp jaw 822 in the direction opposite to the direction of the arrow 844, the engagement of the lever 846 and the surfaces of the slide bar 814 makes it impossible to move clamp jaw 822 closer to substrate 895.

If it is desired that a workpiece is to be spread apart or moved in the direction of arrow 844 by the clamp jaw 822, the clamp jaw 822 is advanced away from the substrate 895 by activation of the trigger handle and driving lever.

Figure 17:
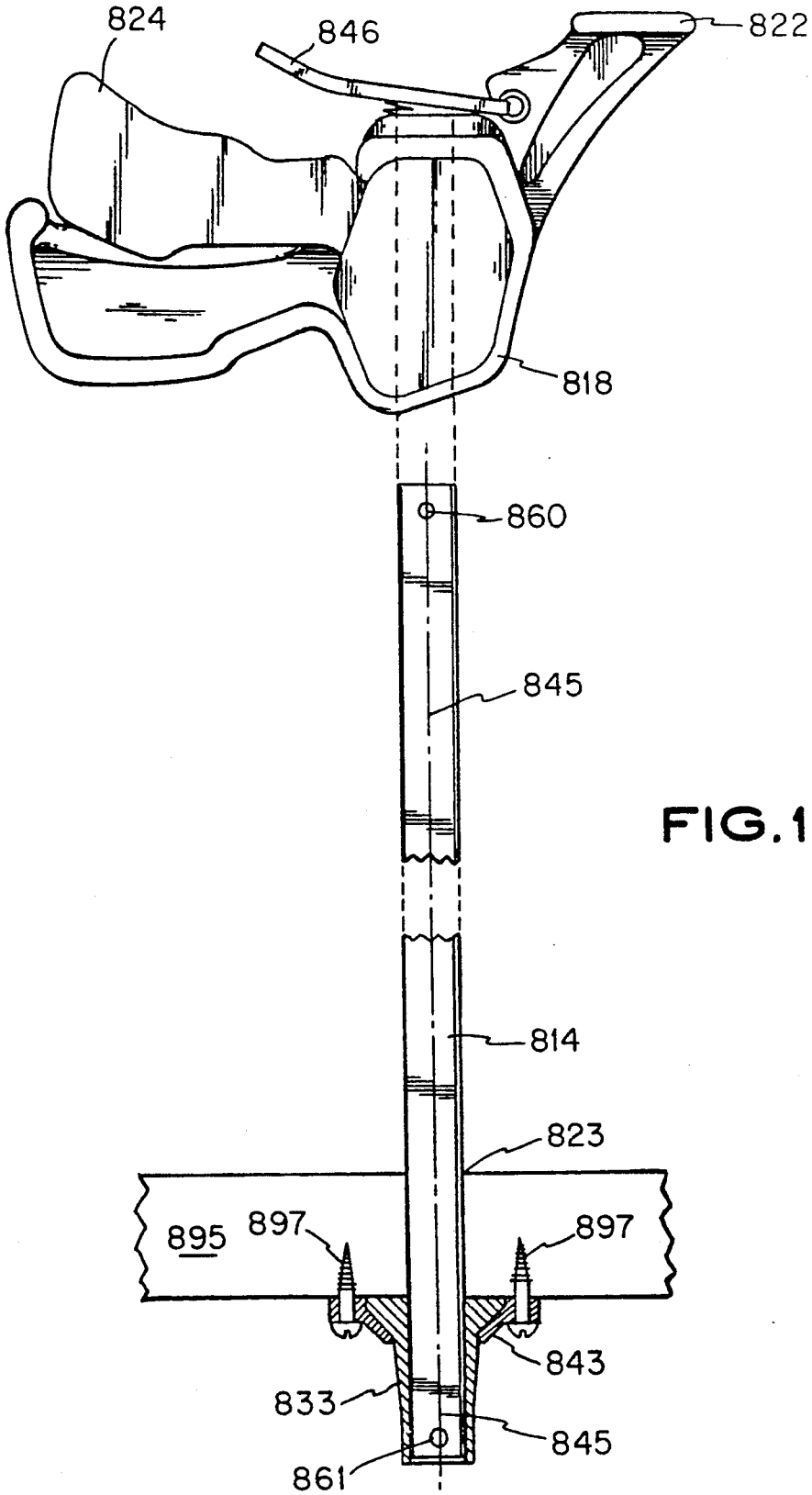

The hand tool shown in FIG. 14, having clamp jaw 822 facing the substrate 895, can easily be converted into the spreading tool illustrated in the embodiment of FIG. 16 with the clamp jaw 822' facing away from the substrate 895. Steps of such conversion are illustrated in FIG. 17.

In order to convert the tool, the stop 860 is removed and clamp jaw 822 is then turned around and positioned on the bar, as illustrated in FIG. 16.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings, shall be interpreted as illustrative and not in a limiting sense.

It is also to be understood that the followiing claims are intended to cover all the generic and specific features of the invention hereindescribed, and all statements of the scope of the invention which, as a matter of language, might be said to fall therebetween.

What is claimed:

1. A hold down clamp system comprising:

an elongate slide bar engaged to a substrate, said slide bar having a substantial portion thereof extending away from said substrate;

a clamp jaw;

support means slidably engaging said slide bar and supporting said clamp jaw so that said clamp jaw is substantially parallel to a surface of said substrate;

one-way drive means for releasably engaging and when engaged, for imparting motion to said clamp jaw relative to said substrate along said slide bar, said clamp jaw being subject to movement relative to said substrate in a predetermined direction along said slide bar when said one-way drive means is engaged;

said one-way drive means having a driving lever, and a braking lever normally engaging said slide bar, said braking lever when engaging said slide bar preventing motion of said clamp jaw opposite to said predetermined direction, and when disengaging said slide bar allowing movement of said clamp jaw opposite to said predetermined direction along said slide bar, said braking lever having an engaging portion extending outwardly from said support means;

a trigger handle pivotally mounted to said support means contacting said driving lever, said engaged driving lever moving said clamp jaw relative to said substrate in said predetermined direction, said support means including a handgrip, a trigger type relationship existing between said trigger handle and said handgrip, said hold down clamp being holdable at said handgrip, said braking lever and the trigger handle being selectively operable by the same hand in such a manner that one of the index and middle fingers is positioned on the engaging portion of the braking lever to actuate the braking lever, while the other fingers encircle and contain the trigger handle and the handgrip.

2. A hold down clamp system as claimed in claim 1, wherein said clamp jaw is subject to reciprocal motion along said slide bar toward and away from said substrate when said one-way drive means is disengaged by application of external forces to said clamp jaw, said clamp jaw being capable of moving in continuous motion along said slide bar.

3. A hold down clamp system as claimed in claim 1, wherein said one-way drive means advances said clamp jaw toward said substrate in increments.

4. A hold down clamp as claimed in claim 1, wherein said braking lever has one end thereof pivotably connected to said support means, and further including first bias means for urging said braking lever into said engagement with said slide bar, withdrawal of said movable jaw away from said fixed jaw being prevented by said engagement, said braking lever being subject to release from engagement with said slide bar by application of an external force to the other end of said braking lever, said force counteracting said first bias means and pivoting said braking lever.

5. A hold down clamp system as claimed in claim 4, wherein said one-way drive means includes a driving lever normally disengaged from said slide rod, and a trigger handle pivotably mounted to said support means and contacting said driving lever, pivoting said handle in a first direction from a standby position forcing said driving lever into engagement with said slide rod, said engaged driving lever moving said slide rod and said movable jaw toward said fixed jaw.

6. A hold down clamp system as claimed in claim 5, wherein said one-way drive means further includes second bias means for normally urging said driving lever out of engagement with said slide bar, and for returning said trigger handle in a direction opposite to said first direction to said standby position after trigger handle operation.

7. A hold down clamp system as claimed in claim 5, wherein the distance of said slide bar advance for each actuation of said handle is directly related to the magnitude of handle motion.

8. A hold down clamp system as claimed in claim 4, wherein said engagements between said levers and said slide bar result from mechanical interference with binding between said bar and levers.

9. A hand tool in accordance with claim 1, wherein the elongate slide bar is rotatably engaged to said substrate to enable rotation of the slide bar about its longitudinal axis.

10. A hand tool comprising:

an elongate slide bar adapted to removably engage a substrate with a substantial portion thereof extendable away from said substrate;

a clamp jaw;

support means slidably engaging said slide bar and supporting said clamp jaw so that said clamp jaw is transverse to said slide bar;

one-way drive means for releasably engaging and when engaged, for imparting motion to said clamp jaw along said slide bar, said clamp jaw being subject to reciprocal movement along said slide bar when said one-way drive means is disengaged;

said one-way drive means having a driving lever, and a braking lever normally engaging said slide bar, said braking lever when engaging said slide bar, preventing motion of said clamp jaw in one of said reciprocal directions, and when disengaging said slide bar allowing movement of said clamp jaw in the other of said reciprocal directions, said braking lever having an engaging portion extending outwardly from said support means;

a trigger handle pivotally mounted to said support means contacting said driving lever, said engaged driving lever moving said clamp jaw in said one of said reciprocal directions, said support means including a handgrip, a trigger-type relationship existing between said trigger handle and said handgrip, said hold down clamp being holdable at said handgrip, said braking lever and the trigger handle being selectively operable by the same hand in such a manner that one of the index and middle fingers is positioned on the engaging portion of the braking lever to actuate the braking lever, while the other fingers encircle and contain the trigger handle and the handgrip.

11. A substrate mounted hand tool comprising:

a substrate having an engaging surface, an elongated slide bar with a longitudinal axis, said slide bar having a distal end passing through said substrate, a substantial portion of said slide bar extending away from said substrate;

a clamp jaw;

support means for slidably engaging said slide bar and supporting said clamp jaw;

one-way drive means for releasably engaging and when engaged, for imparting motion to said clamp jaw relative to said substrate along said slide bar, said clamp jaw being subject to movement relative to said substrate in a predetermined direction along said slide bar when said one-way drive means is engaged;

said one-way drive means having a driving lever, and a braking lever normally engaging said slide bar, said braking lever when engaging said slide bar preventing motion of said clamp jaw opposite to said predetermined direction, a trigger handle pivotally mounted to said support means and contacting said driving lever, said engaged driving lever moving said clamp jaw relative to said substrate in said predetermined direction, said support means including a handgrip, a trigger type relationship existing between said trigger handle and said handgrip;

receiving means connected to said substrate for receiving and rotatably mounting said distal end of said slide bar, said receiving means having a surface situated substantially transversely to said longitudinal axis of the slide bar, said receiving means being positioned in such a manner that said surface slidably engages said substrate.

12. A substrate mounted hand tool as claimed in claim 11, wherein said receiving means has a rotating unit with an elongated opening adapted to receive said distal end of the slide bar, and said surface forming a part of said rotating unit.

13. A substrate mounted hand tool as claimed in claim 12, wherein said substrate has an auxiliary surface positioned oppositely to the engaging surface thereof, and in an assembled condition of said hand tool said surface of the receiving means faces said auxiliary surface of the substrate.

14. A substrate mounted hand tool as claimed in claim 12, wherein said rotating unit having an exterior portion and said rotating unit is connected to said auxiliary surface by a flange having an interior portion, so that at least a part of said exterior portion of the rotating unit slidably engages said interior portion of the flange.

15. A substrate mounted hand tool as claimed in claim 14, wherein said clamp jaw faces said engaging surface.

16. A substrate mounted hand tool as claimed in claim 12, wherein said slide bar and said support means rotate 360°.

17. A substrate mounted hand tool as claimed in claim 12, wherein said substrate is a substantially flat member.

* * * * *